US008717243B2

(12) United States Patent
Yaccarino et al.

(10) Patent No.: US 8,717,243 B2
(45) Date of Patent: May 6, 2014

(54) LOW PROFILE CAVITY BACKED LONG SLOT ARRAY ANTENNA WITH INTEGRATED CIRCULATORS

(75) Inventors: Robert G. Yaccarino, Torrance, CA (US); James A. Carr, Fountain Valley, CA (US); Rohn Sauer, Los Angeles, CA (US); Thomas C. DaVeiga, Lakewood, CA (US); John A. Crockett, Jr., Anaheim, CA (US); Steven E. Bradshaw, West Hills, CA (US); John M. Hadden, IV, Redondo Beach, CA (US); Lonny Richard Walker, Torrance, CA (US)

(73) Assignee: Raytheon Company, Waltham, MA (US)

( * ) Notice: Subject to any disclaimer, the term of this patent is extended or adjusted under 35 U.S.C. 154(b) by 309 days.

(21) Appl. No.: 13/348,015

(22) Filed: Jan. 11, 2012

(65) Prior Publication Data

US 2013/0176186 A1 Jul. 11, 2013

(51) Int. Cl.
*H01Q 1/00* (2006.01)

(52) U.S. Cl.
USPC ..... 343/787

(58) Field of Classification Search
USPC ..... 343/787, 853, 770, 771; 333/1.1
See application file for complete search history.

(56) References Cited

U.S. PATENT DOCUMENTS 3,935,548 A 1/1976 Rosenbaum et al.
4,704,588 A * 11/1987 Kane ..... 333/1.1
5,264,860 A 11/1993 Quan
6,127,984 A 10/2000 Klebe et al.
6,154,176 A * 11/2000 Fathy et al. ..... 343/700 MS
6,388,631 B1 5/2002 Livingston et al.
6,600,453 B1 7/2003 Hadden, IV et al.
6,611,180 B1 8/2003 Puzella et al.
6,653,984 B2 11/2003 Park et al.
6,958,670 B2 10/2005 Winslow et al.
7,032,651 B2 4/2006 Winslow et al.
7,201,217 B2 4/2007 Johnson et al.
7,315,288 B2 1/2008 Livingston et al.

(Continued)

FOREIGN PATENT DOCUMENTS

WO WO 2010/116357 A1 10/2010

OTHER PUBLICATIONS

Written Opinion of the International Searching Authority for International Application No. PCT/US2012/068313, filed Dec. 6, 2012, Written Opinion of the International Searching Authority mailed Mar. 1, 2013 (5 pgs).

(Continued)

*Primary Examiner* — Huedung Mancuso
(74) *Attorney, Agent, or Firm* — Christie, Parker & Hale, LLP

(57) ABSTRACT

The present invention relates to active electronically scanned array antennas. A thin, low cost design is provided by coupling electromagnetic energy into periodically driven long slots (205) using circulators with integrated probes (107). The long slots (205) are formed as grooves (114) in a conductive base plate (103), each groove (114) bracketed on both sides by conductive strips (108). The circulators with integrated probes (107) are installed between the conductive strips (108) and the base plate (103), to reduce fabrication costs of the machined parts and to facilitate the making of connections between the circulators and the antenna electronics. The probes (128) protrude partway into the slots (205) and provide coupling to waves propagating in free space.

20 Claims, 7 Drawing Sheets

(56) References Cited

U.S. PATENT DOCUMENTS

| | | | | |
|---|---|---|---|---|
| 7,331,795 | B2 | 2/2008 | Duke | |
| 7,348,932 | B1 * | 3/2008 | Puzella et al. | 343/853 |
| 7,907,030 | B2 * | 3/2011 | Vaughn et al. | 333/1.1 |
| 8,279,131 | B2 * | 10/2012 | Puzella et al. | 343/853 |
| 2005/0151215 | A1 | 7/2005 | Hauhe et al. | |
| 2009/0044399 | A1 | 2/2009 | Quil et al. | |
| 2010/0066631 | A1 | 3/2010 | Puzella et al. | |

OTHER PUBLICATIONS

International Search Report for International Application No. PCT/US2012/068313, filed Dec. 6, 2012, International Search Report dated Feb. 22, 2013 and mailed Mar. 1, 2013 (4 pgs.)

Declaration of co-inventor, John A. Crockett, Jr., pertaining to U.S. Appl. No. 13/348,015; Declaration dated Mar. 8, 2012, 2 pages.

* cited by examiner

LOW PROFILE CAVITY BACKED LONG SLOT ARRAY ANTENNA WITH INTEGRATED CIRCULATORS

BACKGROUND

1. Field

Embodiments described herein relate to array antennas and in particular to active electronically scanned array antennas.

2. Description of Related Art

An active electronically scanned array (AESA) antenna is an antenna comprising multiple radiators, or elements, the relative amplitude and phase of which can be controlled, making it possible to steer the transmit or receive beam without moving the antenna. Such an antenna includes an aperture for transmitting or receiving waves traveling in free space, and it may include back-end circuitry, including electronics modules for generating signals to be transmitted and for processing received signals. Each element within the aperture may incorporate, or be connected to, a circulator, which separates the signals corresponding to transmit and receive channels, and which is connected to a transmit channel and a receive channel in the back-end electronics. The circulator may be fabricated as a microstrip circuit on a ferrite substrate, with a permanent magnet secured on or near the signal side of the substrate, and with a magnetic material, i.e., a material with a high magnetic permeability, on the ground plane side of the substrate to shape the magnetic field produced by the permanent magnet.

Prior art aperture structures include notch radiator arrays of the type described in U.S. Pat. No. 6,600,453, assembled from long, flat "sticks," or "slats," each including a series of notch radiators. In such an embodiment, a certain minimum notch depth may be required to achieve acceptable bandwidth, and the circulators may be installed in the plane of the sticks, resulting in a relatively deep aperture.

Another prior art aperture structure is disclosed in U.S. Pat. No. 7,315,288. This structure includes long slots spanning multiple array elements, periodically driven along their lengths. Probes in the form of current loops, located at intervals along each slot, excite the long slot. The probes, which are balanced transmission line or feed structures, are connected to single-ended transmit and receive electronics through baluns. In such a structure the baluns may be behind the radiators, and the circulators behind the baluns, and this combination may increase the depth of the antenna. Moreover the baluns may be a cause of electrical loss.

Especially in space-constrained applications such as in aircraft, it may be important to reduce the thickness and, thereby, the volume of an array antenna; moreover it is desirable to produce the antenna at a modest cost. Thus, there is a need for a low-cost, low-profile AESA antenna.

SUMMARY

Embodiments of the present invention provide a low-cost, low-profile array antenna. In an exemplary embodiment, the array antenna comprises an array of radiating elements, comprising a base plate having a surface comprising a plurality of grooves, a plurality of conductive strips on the base plate, and a plurality of circulators with integrated probes. Each circulator with integrated probe is coplanar with the base plate and secured between one of the conductive strips and the base plate. The conductive strips may be made of magnetic stainless steel, may have chamfers on their edges, and may be secured to the base plate using screws inserted through clearance holes in the conductive strips. The clearance holes in the conductive strips may be counterbored so that the screw heads do not protrude above the surface of the conductive strips, and oversized counterbores may be used to reduce the weight of the conductive strips. Additional lightening pockets may be formed in the conductive strips to further reduce weight. A wide-angle impedance matching (WAIM) sheet may be bonded to the front surface of the conductive strips.

In one embodiment of the invention, the circulators with integrated probes may be formed as microstrip circuits on ferrite substrates, with conductive pads at their transmit and receive ports. The array antenna may further include a multilayer printed wiring board (PWB) behind the array of radiating elements, and connections may be made between the multilayer PWB, and the conductive pads on the circulators with integrated probes, using straight coaxial conductor assemblies comprising floating spring pin center conductors. The antenna array may also include an eggcrate structure containing electronics modules, behind the multilayer PWB. The multilayer PWB may include a stripline translation layer to compensate for misalignments between connections in the electronics modules and the corresponding connections on the circulators with integrated probes. The multilayer PWB may also include a corporate feed network. The eggcrate structure may include a coolant manifold for cooling the electronics modules. The electronics modules may be held in place in the eggcrate structure by retainer springs.

BRIEF DESCRIPTION OF THE DRAWINGS

Features, aspects, and embodiments are described in conjunction with the attached drawings, in which.

DETAILED DESCRIPTION

The detailed description set forth below in connection with the appended drawings is intended as a description of the presently preferred embodiments of a low profile array antenna provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Figure 1:
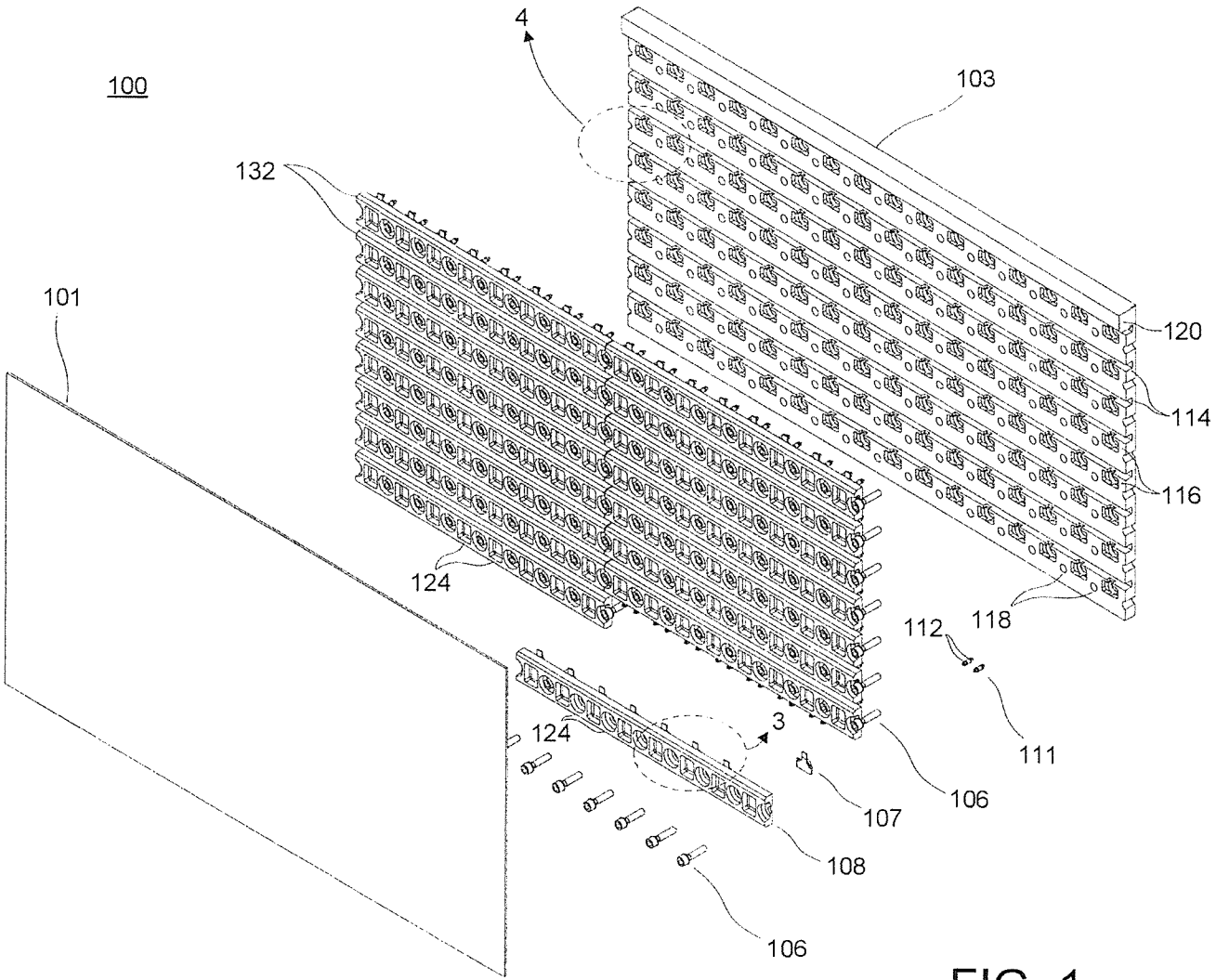
FIG. 1 is a front exploded perspective view of a long slot aperture according to an embodiment of the present invention.
Figure 6:
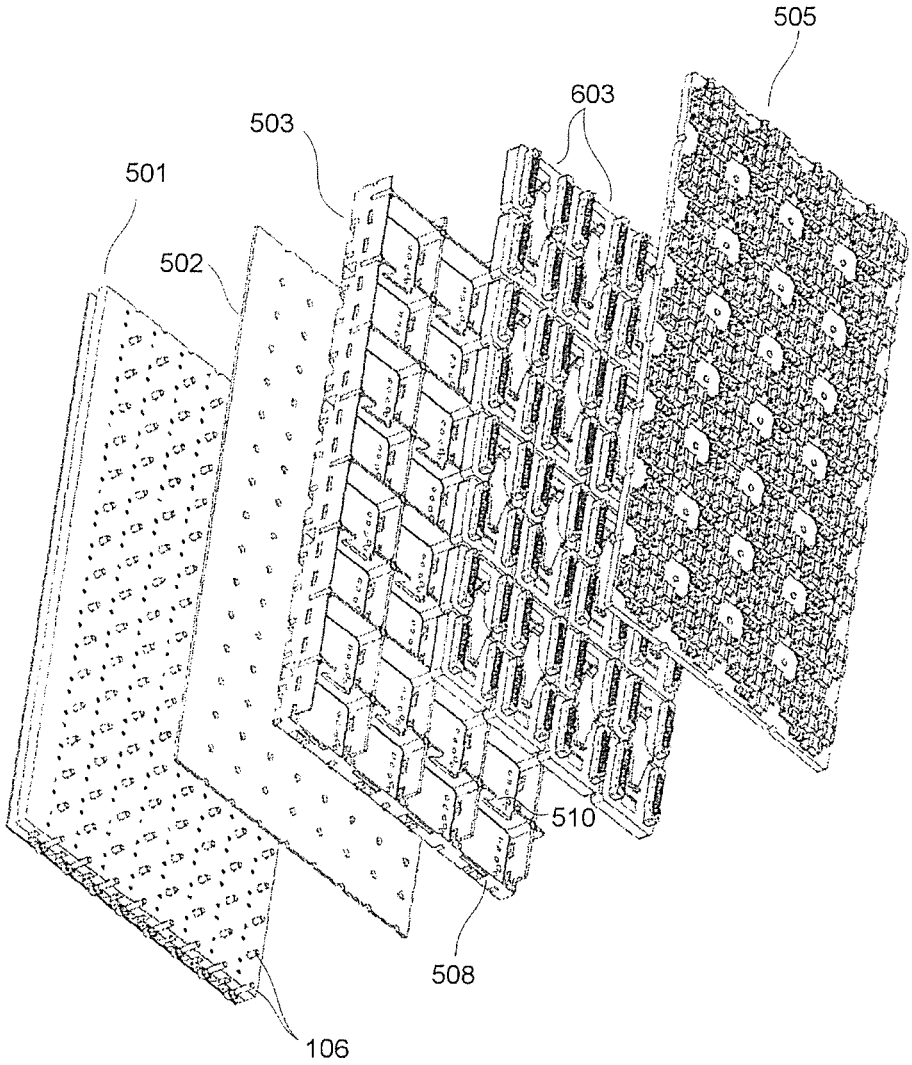
FIG. 6 is a rear exploded perspective view of a low profile long slot array antenna according to an embodiment of the present invention.

For the purpose of this description the surface of the antenna from which radiation may emanate will be referred to as the "front" of the antenna. Referring to FIG. 1, a long-slot aperture 100 may include a wide-angle impedance matching (WAIM) sheet 101, conductive strips 108, circulators with integrated probes 107, and a base plate 103. The assembly may be held together by screws 106 installed through counterbored holes 122 in the conductive strips 108 and clearance holes 118 in the base plate 103, and threaded into threaded holes in a support plate such as the front wall 508 of a structure known as an "eggcrate" structure 503 (FIG. 6).

The base plate 103, which may be made of aluminum, contains several troughs or grooves 114 spanning its width, and several circulator cavities 116 immediately below, and spaced along, each groove 114. The base plate 103 also has screw clearance holes 118, and alignment pin holes (not shown).

Figure 2:
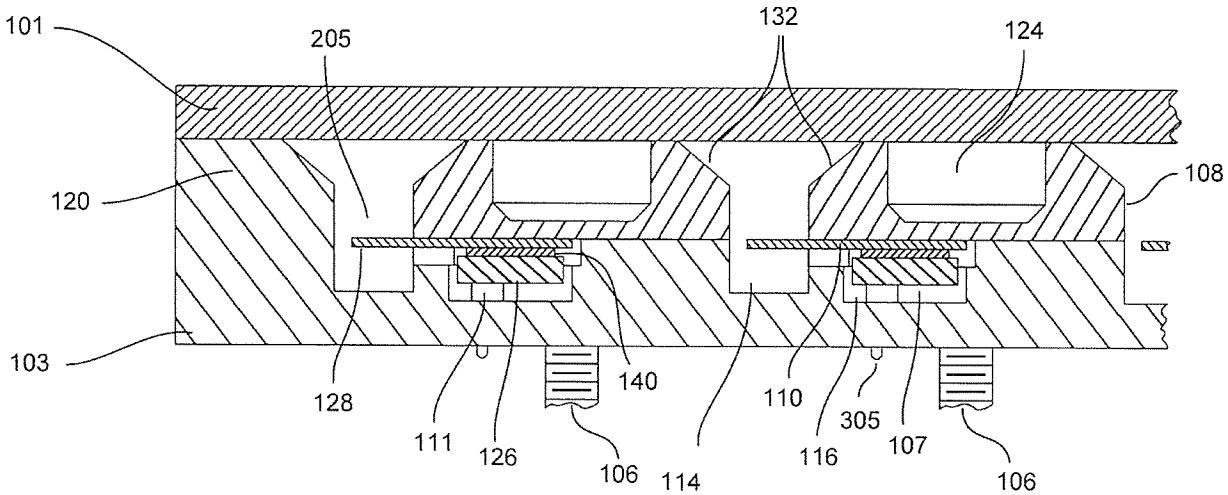
FIG. 2 is an enlarged fragmentary cross sectional view of a portion of a long slot aperture according to an embodiment of the present invention.

Although the invention will function in any orientation, for the purpose of this description the orientation of the aperture, and of the antenna, will be that shown in FIG. 1. Each conductive strip 108, except those in the bottom row, is installed against the base plate 103 so that its upper edge is flush with the lower edge of one groove 114, and its lower edge is flush with the upper edge of the adjacent groove immediately below. The groove 114 and the edges of the adjoining conductive strips 108 form a slot 205 deeper than the groove 114 by itself (FIG. 2). The edges of the conductive strips 108 may have chamfers 132 resulting in a slot 205 that flares at the front (FIG. 2). The installation of the lowest row of conductive strips differs only in that there is no groove 114 below them in the base plate 103. A conductive strip 108 is not needed above the uppermost groove if the base plate 103 has a thicker region or lip 120, along its upper edge to provide the upper wall of the uppermost slot (FIG. 2).

FIG. 2 shows an enlarged cross-sectional view through the slot 205, showing circulator cavities 116 and lightening pockets 124 in cross section, as well as circulators with integrated probes 107.

Figure 3:
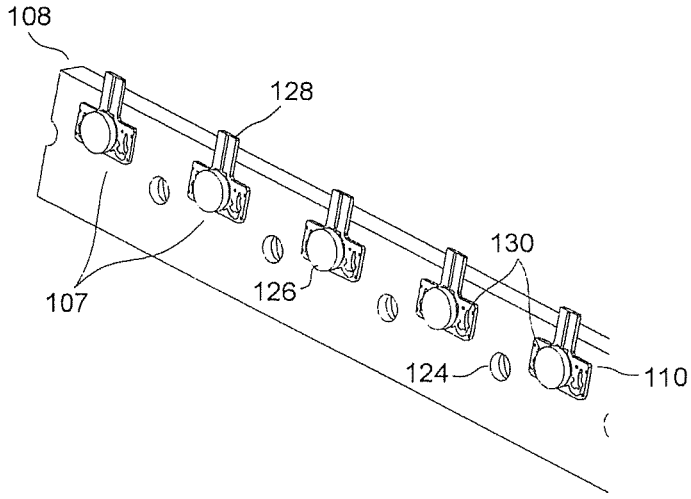
FIG. 3 is an enlarged rear perspective view of circulators on conductive strips, in a portion, situated within line 3 of FIG. 1, of the aperture.

The aperture 100 also includes a plurality of circulators with integrated probes 107. Referring to FIG. 3, each circulator with integrated probe 107 includes a circulator substrate 110, a permanent magnet 126, and a dielectric spacer 140 (FIG. 2) installed between the permanent magnet 126 and the circulator substrate 110. The substrate 110 may be made of ferrite. The magnet 126 may be bonded to the dielectric spacer 140, and the spacer 140 to the substrate 110, with a suitable adhesive, so that the dielectric spacer 140 will support the permanent magnet 126 at the desired separation from the ferrite substrate 110.

The circulator with integrated probe 107 includes a circulator portion and a probe portion 128. The circulator portion separates outbound waves from inbound waves at the antenna port, routing them from the transmit port of the circulator, or to the receive port of the circulator, respectively. The circulator portion may be constructed, for example, in the manner of the circulator disclosed in U.S. Pat. No. 3,935,548. The probe portion 128 of the circulator with integrated probe 107 couples waves traveling in a microstrip transmission line at the antenna port of the circulator to waves propagating in free space in front of the radiating aperture. The probe portion 128 may be formed as a conductive trace extending outwards from the circulator, on a tab formed for this purpose in the substrate 110. In the assembled aperture 100, the probe portion 128 may protrude into the slot 205 (FIG. 2).

During assembly, the circulators with integrated probes 107 may be placed onto the conductive strips 108 and secured in place with an adhesive, such as conductive epoxy. This placement may be performed manually or robotically. The thickness of the adhesive layer may be approximately 0.002 inches (51 microns).

The conductive strips 108 are made of conductive material, which may also be magnetic, and which may have a coefficient of thermal expansion (CTE) similar to that of the substrate 110. For proper function, in one embodiment each circulator with integrated probe 107 will be installed on the surface of a part made of a magnetic material. This part completes the magnetic circuit of the permanent magnet 126, resulting in a suitable magnetic field in the circulator. The surface on which the circulator with integrated probe 107 is installed may also have a coefficient of thermal expansion similar to that of the substrate 110.

In one embodiment, the conductive strips 108 are made of a magnetic stainless steel known as corrosion resistant steel (CRES). This material has all three desired properties: it is conductive, it is magnetic, and its CTE is similar to that of ferrite. In another embodiment the conductive strips 108 may be made of conducting material that is not magnetic, such as aluminum, and separate inserts made of a magnetic material with a suitable CTE may be installed between the circulators with integrated probes 107 and the conductive strips 108. This embodiment may however result in increased fabrication cost.

The WAIM sheet 101 may be approximately 0.040 inches (1000 microns) thick, and it may be formed of a cyanate ester quartz laminate, fabricated from several sheets, each 0.005 inches (130 microns) thick, cured together. It provides an impedance match to free space, and it may also provide an environmental seal.

The clearance holes 118 in the conductive strips 108 may be counterbored so that in the assembly the heads of the screws 106 do not protrude above the front surfaces of the conductive strips 108. This allows a flat WAIM sheet 101 to be bonded to the front surfaces of the conductive strips 108. A polysulfide adhesive containing glass beads of uniform diameter may be used to bond the WAIM sheet 101 to the conductive strips 108. For example, an adhesive containing 0.005 inch (127 micron) diameter beads will result in a 0.005 inch (127 micron) thick bond line between the WAIM sheet 101 and the conductive strips 108. To reduce weight, the counterbored clearance holes 122 may have oversized counterbores, and lightening pockets 124 may be machined into the front face of each conductive strip 108. Provided the lightening pockets 124 and counterbores are not too large, the contact area between the conductive strips 108 and WAIM sheet 101 may be adequate to form a strong bond between the conductive strips 108 and the WAIM sheet 101, resulting in a mechanically robust assembly. The conductive strips 108 may have no machined features except for the counterbored holes 122, chamfers 132, lightening pockets 124, and alignment pin holes, and, of these, only the alignment pin holes may require precision machining, which may result in low fabrication costs. The conductive strips 108 may be fabricated using computer numerical control (CNC) methods, such as fabrication on a CNC milling machine.

Figure 4:
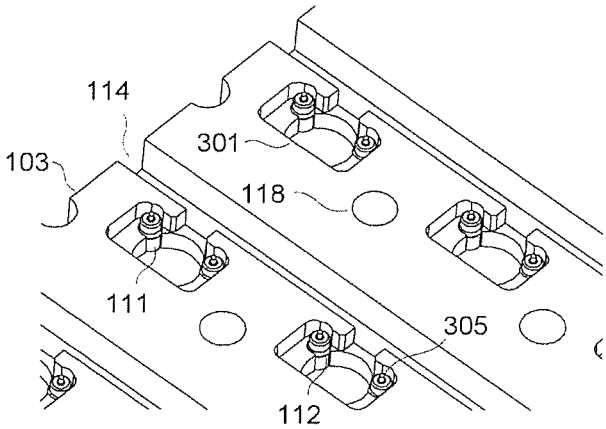
FIG. 4 is an enlarged front view of a portion, situated within line 4 of FIG. 1, of the aperture.

Referring to FIG. 4, the base plate 103 has two through holes in each circulator cavity 116 for two coaxial connectors, to form coaxial transmission line connections to the transmit and receive ports of the circulator with integrated probe 107. Each coaxial connector 111 may consist of a dielectric cladding 134 holding a center conductor 305, one end of which contacts a corresponding conductive pad 130 (FIG. 3) on a circulator with integrated probe 107 when the antenna is assembled. The other end of the center conductor 305 may contact a conductive pad on a multilayer PWB 502, which provides connections to antenna electronics modules 603 (FIG. 6). In such an embodiment, the conductive wall of the through hole, the dielectric cladding 134, and the center conductor 305 together form a coaxial transmission line. To provide contact pressure at both ends, the center conductor 305 in the coaxial connector 111 may be a floating spring pin, i.e., a compressible pin with an internal spring, fitting loosely within the dielectric cladding 134. In another embodiment, the spring pin may comprise a non-floating central portion that is secured within the cladding 134, and two spring-loaded contact pins, one at each end; however, this style of connector may be costlier to fabricate.

In an alternate embodiment, each circulator with integrated probe 107 may be installed with its permanent magnet 126 nearer the front of the antenna. In this case vias, or edge-wrap metallization, may be used to form connections between the front and back surfaces of the substrate 110, and in particular to connect conductive traces on the front surface of the substrate 110 to the conductive pads 130 on the back surface of the substrate 110.

Figure 5:
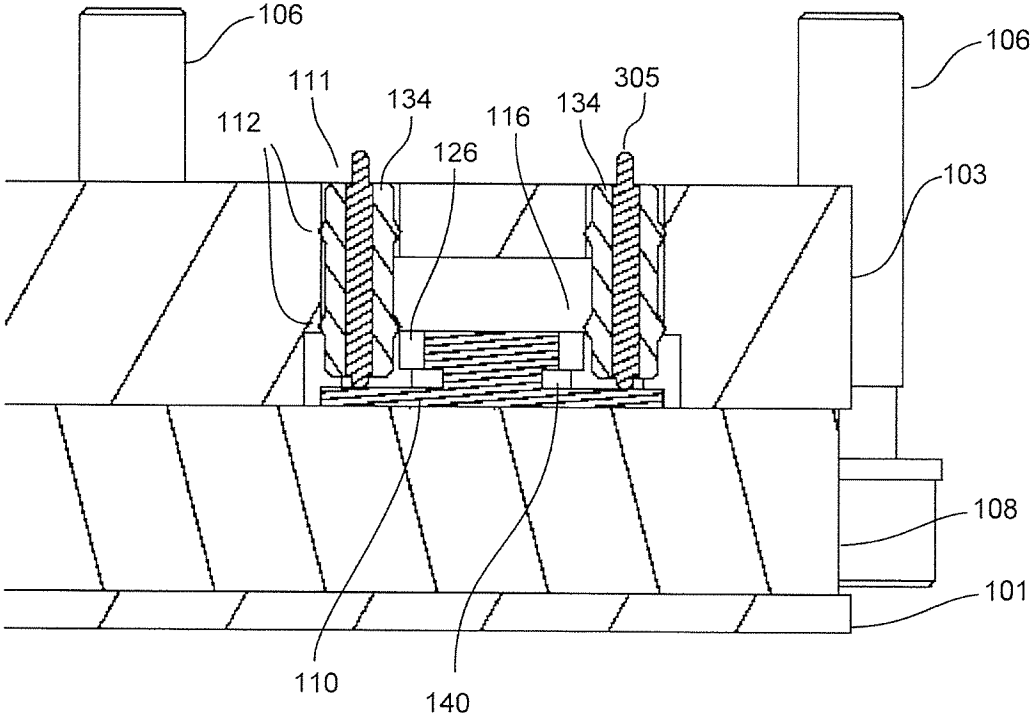
FIG. 5 is an enlarged cross sectional view of a portion of a long slot aperture according to an embodiment of the present invention.

The dielectric cladding 134 of the coaxial connector 111 may have a circumferential ridge 112 at each end (FIG. 5). This circumferential ridge 112 may be nearly the same diameter as the hole, or slightly larger, so that it keeps the connector centered in the hole in the base plate. If, by design or as a result of manufacturing tolerances, the diameter of the circumferential ridge 112 exceeds that of the hole, then the circumferential ridge 112 will deform slightly during insertion of the coaxial connector 111, resulting in a modest insertion force. If, instead of having circumferential ridges 112, the dielectric cladding had a uniform outer diameter along its length, very tight fabrication tolerances would be required to simultaneously achieve accurate centering of the connector and an acceptable insertion force.

The base plate 103 may be made of aluminum and may be fabricated using a CNC machining process. In this application aluminum has several advantages over other materials: high electrical conductivity, low density, and being inexpensive to machine. In another embodiment the base plate may be made of a dielectric material with a conductive surface coating.

FIG. 5 shows a cross-sectional view of an exemplary embodiment of an aperture 100, based on a cutting plane passing through two coaxial connectors 111. Electromagnetic fields propagating along the coaxial connectors 111 and in the corresponding microstrip transmission lines on the substrate 110 form a transition between these transmission line structures. This transition represents an electrical discontinuity in the transmission line path, and precautions may be taken to minimize the reflections this discontinuity may otherwise cause. Such precautions may include adjusting the dimensions and shape of the center conductor 305 and ground conductors at and near the transition. They may also include adjusting the parameters of matching arms on the circulator with integrated probe 107. These matching arms may include, for example, narrow or wide sections in the transmission lines connecting the circulator to the conductive pads 130.

The details of the aperture design may be adjusted using software such as HFSS, sold by Ansys Incorporated, of Canonsburg, Pa. Using this software, a Floquet cell method, also known as a unit cell method or infinite array method, may be used to determine the electromagnetic fields in and in front of one antenna element within an infinite array. This solution then approximates the fields in and in front of an antenna element of a large finite array. Using this approach, detailed design parameters such as the dimensions of the slot 205, the size and angle of the chamfers 132, the dimensions of the microstrip sections in the matching arms, the shape of the conductive trace and the portion of the substrate in the probe 128, the thickness of the WAIM sheet 101, and the gap between the end of the probe 128 and the opposing wall of the slot 205 may be adjusted to obtain desired values, as functions of frequency and scan angle, for measures of performance such as the active reflection coefficient.

The aperture 100 may be integrated with an antenna back end, as shown in FIG. 6. Screws 106 extend through counterbored holes 122 in the conductive strips 108, through clearance holes 118 in the base plate 103 (FIG. 1) and in the multilayer PWB 502, and into threaded holes in the front wall 508 of the eggcrate structure 503, securing these parts together. Socket head cap screws, which unlike recessed cruciform screws may be installed with highly repeatable tightening torque, may be used. Alignment pins may be installed in corresponding holes in the conductive strips 108 and base plate 103 during assembly to ensure accurate registration of these parts. The circulators with integrated probes 107 may have been bonded to the conductive strips 108 in a prior assembly step (FIG. 3).

Figure 7:
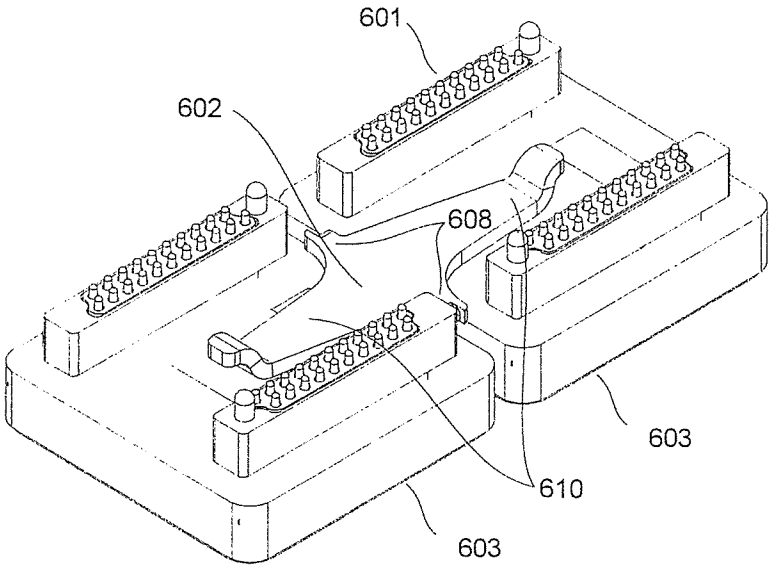
FIG. 7 is an illustration of an electronics module and retainer spring according to an embodiment of the present invention.

Referring to FIG. 7, electronics modules 603 may be held in place in the eggcrate structure compartments by retainer springs 602. Each retainer spring 602 has two wings 610, each of which holds an electronics module 603 against the front wall 508 of the eggcrate structure 503. Each retainer spring 602 also has two arms 608 that engage the undercut ends of a cutout 510 in the eggcrate structure wall separating the compartments containing the two electronics modules secured by the retainer spring 602.

Referring to FIG. 6, a DC motherboard 505 may be secured to the rear surface of the eggcrate structure 503, covering the compartments. The eggcrate structure 503 forms the structural backbone of the antenna, and its front wall 508 may contain a coolant manifold, which may be of the type disclosed in U.S. Pat. No. 7,032,651, comprising coolant cavities containing high density stamped or machined finstock. Coolant flowing through this manifold removes heat generated by the electronics modules 603. Gaskets may be used between the electronics modules 603 and the front wall 508 of the eggcrate structure 503, for the purpose of forming both a good electrical contact and a good thermal contact between the electronics module 603 and the front wall 508. Such gaskets may contain a beryllium-copper foil with spring fingers for ensuring good electrical contact. They may also contain layers of thermally conductive material on both sides of the beryllium-copper foil for providing good thermal contact. The retainer springs 602 provide adequate pressure on the electronics modules 603 to compress the gasket. In one embodiment the retainer springs 602 may exert approximately 30 pounds (13.6 kg) of pressure on each electronics module 603 when installed.

Referring to FIG. 6, the multilayer PWB 502 may serve two purposes: it may provide a stripline corporate feed network and a stripline translation layer. This may be accomplished by using a PWB 502 consisting of four layers of dielectric and five conductive layers. Two layers of dielectric, e.g., the first two layers adjacent the front wall 508 of the eggcrate structure 503, together with the three conductive layers in contact with them, may form a stripline corporate feed network. The remaining layers may form a stripline translation layer. The multilayer PWB 502 may be fabricated from copper conductive layers and dielectric layers made of a high molecular weight material such as CLTE, sold by Arlon-MED of Rancho Cucamonga, Calif. Other metals, or combinations of different metals, may be used to form the conductive layers. For example, it may be undesirable to have a copper layer in contact with an aluminum base plate 103 or an aluminum front wall 508. In this case each outer conductive layer of the multilayer PWB 502 may instead be formed as a copper strike layer, plated with nickel and gold. Gold plating may improve corrosion resistance.

The translation layer compensates for offsets between conductive pads on the electronics modules 603 and corresponding pads 130 on the circulators with integrated probes 107. For example, one electronics module 603 may have a pair of conductive pads which must be connected to a pair of conductive pads 130 on a circulator with integrated probe 107, but the separation between the pads in each pair may be different, so that straight coaxial connectors 111, perpendicular to the plane of the array, cannot be used. The translation layer resolves this difficulty by providing one pad, facing forward, aligned with a pad 130 on the circulator with integrated probe 107 and another pad, facing rearward, connected to the first with a stripline trace, aligned with the corresponding pad on the electronics module 603. Straight coaxial connectors 111 can then be used to form connections between the translation layer and the circulators with integrated probes 107 and between the translation layer and the electronics modules 603. In each case, coaxial connectors 111 with spring pin center conductors 305 may be used.

The corporate feed network distributes the outgoing signal to, and combines the received signal from, the electronics modules 603. As with the translation layer, connections between the corporate feed layer and the electronics modules 603 may be made using straight coaxial connectors 111 with spring pin center conductors 305.

The multilayer PWB 502 is sandwiched between two metal surfaces, viz., the surfaces of the base plate 103 and the front wall 508 of the eggcrate structure 503. Thus, in another embodiment, one or both of the stripline layers in the multiplayer PWB 502 may be replaced with a channelized microstrip layer, by machining channels into the adjacent metal surface and modifying the PWB 502 accordingly.

Vias may be used in the multiplayer PWB 502 for several purposes. Signal vias may be used to bring a signal trace to the surface of the multilayer PWB 502. A coaxial connector 111 may then form a connection with a surface pad surrounding such a signal via. The surface pad is preferably sufficiently large to ensure contact with the center conductor 305 of the coaxial connector 111 in the presence of manufacturing tolerances, but sufficiently small to avoid shorting against the wall of the hole holding the coaxial connector 111. Ground vias, which connect ground layers together, may be used to provide electrical isolation between multiple signal paths in the multilayer PWB 502, or to provide a uniform characteristic impedance for the transmission lines in the multilayer PWB 502, especially at signal vias. Vias also may serve a mechanical purpose. Unlike dielectrics such as CLTE, vias have excellent dimensional stability in the presence of prolonged mechanical pressure. Absent the vias, the multilayer PWB 502 might become compressed after prolonged exposure to the clamping pressure of the screws 106, allowing the entire assembly to loosen. Vias in the multilayer PWB 502 may prevent this from occurring.

Referring to FIG. 6, the DC motherboard 505 may provide low frequency functions such as supplying DC power to the electronics modules 603, and it may be secured to the eggcrate structure 503 with threaded fasteners. Connections between the electronics modules 603 and the DC motherboard 505 may be formed using DC connectors 601 (FIG. 7) which in one embodiment may comprise a dielectric body with multiple holes, and spring pin conductors installed in the holes to provide connections between corresponding contact pads on the electronics modules 603 and DC motherboard 505.

Although limited embodiments of a low profile array antenna have been specifically described and illustrated herein, many modifications and variations will be apparent to those skilled in the art. Accordingly, it is to be understood that the low profile array antenna constructed according to principles of this invention may be embodied other than as specifically described herein. The invention is also defined in the following claims.

What is claimed is:

1. An array of radiating elements comprising:

a base plate (103) having a surface comprising a plurality of grooves (114), a plurality of conductive strips (108) on the base plate (103), and a plurality of circulators with integrated probes (107), each of the circulators with integrated probes (107) being coplanar with the base plate (103) and secured between one of the conductive strips (108) and the base plate.

2. The array of claim 1, wherein at least one of the conductive strips (108) is made of magnetic stainless steel.

3. The array of claim 1, wherein at least one of the conductive strips (108) is secured to the base plate (103) using screws (106) inserted through clearance holes (118) in the conductive strip.

4. The array of claim 3, wherein at least one of the clearance holes (118) is counterbored.

5. The array of claim 4, wherein at least one of the conductive strips (108) further comprises lightening pockets.

6. The array of claim 1, wherein at least one of the conductive strips (108) comprises a chamfer (132) on at least one of its long edges.

7. The array of claim 1, wherein at least one of the circulators with integrated probes (107) is secured to a conductive strip with adhesive.

8. The array of claim 1, wherein the base plate (103) is made of aluminum.

9. The array of claim 1, further comprising a wide-angle impedance matching (WAIM) sheet (101) secured to at least one of the conductive strips (108).

10. The array of claim 9, wherein the WAIM sheet (101) is secured to at least one of the conductive strips using a polysulfide adhesive containing glass beads of uniform diameter.

11. The array of claim 1, wherein at least one electrical connection to at least one of the circulators with integrated probes (107) is formed by a compressible pin in contact with a conductive pad on the circulator with integrated probe.

12. The array of claim 1, further comprising a printed wiring board (PWB) (502) secured to the base plate.

13. The array of claim 12, wherein the printed wiring board (502) further comprises a corporate feed network and a translation layer.

14. The array of claim 13, in which at least one of the corporate feed network and the translation layer is a stripline circuit.

15. The array of claim 13, in which at least one of the corporate feed network and the translation layer is a channelized microstrip circuit.

16. The array of claim 12, further comprising an egg-crate structure (503) comprising a plurality of compartments, wherein at least one compartment contains an electronics module.

17. The array of claim 16, wherein the eggcrate structure (503) comprises a coolant manifold.

18. The array of claim 16, wherein at least one electronics module (603) is secured in a compartment of the eggcrate structure (503) by a retainer spring (602).

19. The array of claim 13, wherein at least one conductor in the translation layer is connected to a circulator with integrated probe by at least one straight coaxial conductor assembly (111).

20. The array of claim 19, wherein at least one coaxial conductor assembly (111) comprises a floating spring pin.

* * * * *